United States Patent [19]

Paroty

[11] 3,985,457

[45] Oct. 12, 1976

[54] WRITING IMPLEMENT HAVING A REPLACEABLE REFILL

[75] Inventor: Jean-Marie Paroty, Ableiges, France

[73] Assignee: Interlight, Villars-sur-Glane, Fribourg, Switzerland

[22] Filed: July 21, 1975

[21] Appl. No.: 597,504

[30] Foreign Application Priority Data

July 26, 1974 France ..... 74.26096

[52] U.S. Cl. ..... 401/209

[51] Int. Cl.[2] ..... B43K 7/00

[58] Field of Search ..... 220/335, 343; 401/209, 401/134, 135, 198, 199; 46/145, 146; 222/556

[56] References Cited

UNITED STATES PATENTS

| | | | |
|---|---|---|---|
| 3,081,010 | 3/1963 | Tupper | 222/556 X |
| 3,503,544 | 3/1970 | Setera | 222/556 |
| 3,872,996 | 3/1975 | Dogliotti | 222/556 X |

FOREIGN PATENTS OR APPLICATIONS

| | | | |
|---|---|---|---|
| 422,157 | 7/1947 | Italy | 401/135 |

*Primary Examiner*—Lawrence Charles
*Attorney, Agent, or Firm*—Brisebois & Kruger

[57] ABSTRACT

A writing implement has a replaceable refill which is insertable through an opening in the base of the body. The base includes a pivotable flap which opens and closes the opening. The flap is provided with two ramps which can engage the end of the refill and respectively move it under stop means for retaining the end of the refill under the base on closing the flap and move it towards the opening when the flap is opened.

9 Claims, 4 Drawing Figures

WRITING IMPLEMENT HAVING A REPLACEABLE REFILL

Figure 1:
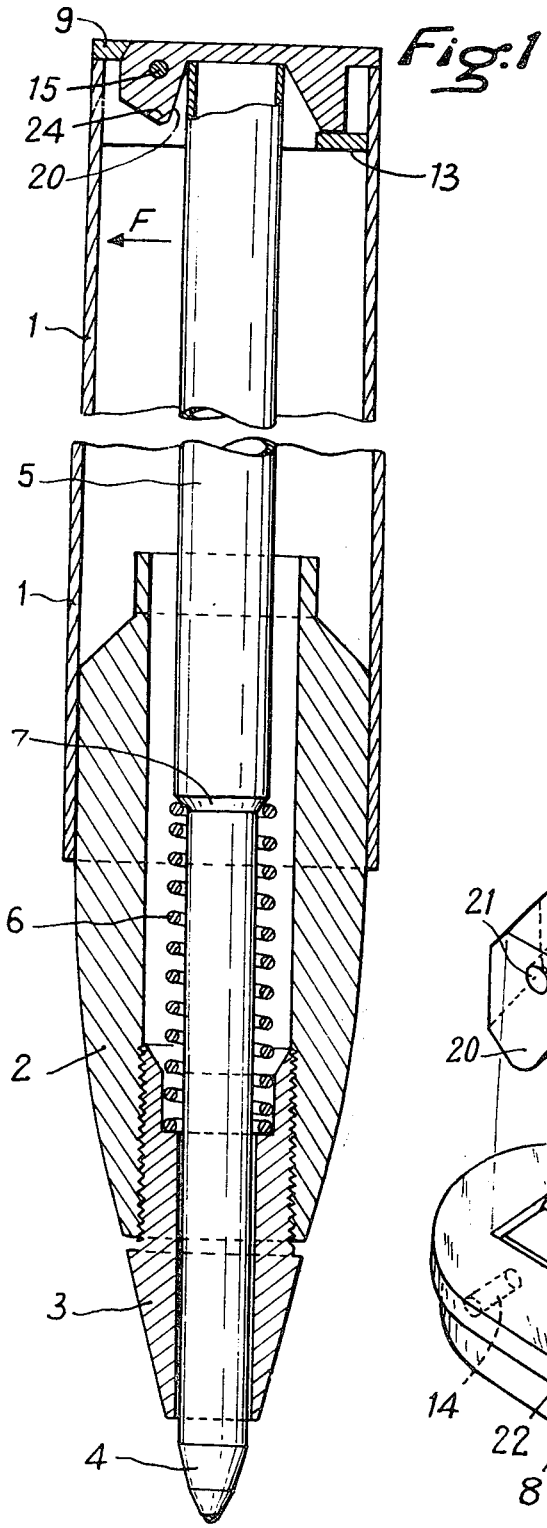

The present invention relates to an pen having a replaceable refill such as, for example, a fountain pen, a ball-point pen, a felt-point pen, a nylon-point pen, or a propelling pencil or any other writing implement. The invention can also be applied to other analogous objects which receive an elongated replaceable refill. The refill is also known as a replaceable container or cartridge.

Various types of pens having replaceable refills are already known. Certain of these have a body which at its lower end has an orifice through which is passed the refill which itself carries a writing head having a thread which is screwed into the body. Others have a body in two parts which are screwed into one another, the refill being replaced by unscrewing the said body and screwing together again after replacing the refill.

In others the worn refill is replaced and the new refill inserted via the base of the body which, to this end, has a screwable cap permitting the sealing of the base when the refill is introduced into the body by pushing back the refill in opposition to a return spring.

These prior art constructions have, however, a certain number of disadvantages. Thus, when the refill, having a writing head, is screwed by means of its writing head there is a risk of the user getting dirty fingers by gripping the head. In the case of bodies in two parts, the separation between the two parts is always visible, making it impossible to form a movable body in one piece which is particularly desirable when the pen body is made from metal, for example, of precious metal. It is then important for the body to be as thin as possible and it is then necessary to provide within the body means permitting the connection of the two parts thereof, thereby making the construction of the pen more complicated.

Finally, pens having a bottom which is sealable by means of a screwed cap have the disadvantage that it is always difficult to screw the cap and may in fact become impossible without using a tool if, as often happens, the screw thread jams.

The present invention aims at obviating these disadvantages and supplying a pen or analogous object having a replaceable refill wherein the introduction and removal of the refill takes place via an orifice made in the base of the body and which is of simple manufacture and particularly easy and reliable in operation.

The object of the invention is a pen or analogous object having a replaceable refill comprising a body, a refill located in the body, a spring which moves the refill towards the base of the body, an orifice in the base of the body for the passage of the refill and means for closing and opening the orifice for replacing the refill, in which the base of the body comprises a flap pivoting about a spindle which is substantially perpendicular to the flap to open and close the refill passage orifice made in the base and stop means in the base which are laterally staggered relative to the said orifice and against which the refill end can strike under the action of the spring, whereby the flap carries a first ramp at a point remote from the spindle for laterally moving the refill end beneath the said stop means under the action of closing the flap and a second ramp at a point closer to the spindle for laterally moving the said refill end towards the passage orifice under the action of opening the flap.

According to an advantageous embodiment the stop means can comprise the actual edges of the orifice and more specifically the inner wall of the base constituting these edges. Advantageously the passage orifice, whose width is greater than the refill diameter can be extended in the direction of the flap spindle by an opening which is narrower than the refill diameter and which receives the flap portion which is closest to the spindle, i.e. that carrying the said second ramp.

The refill introduction orifice is preferably slightly axially staggered relative to the refill spindle once the refill is in position in the body in such a way that the refill penetrates the body slightly obliquely and is then centred on the spindle by the first ramp during the closing of the flap.

According to a preferred embodiment locking means are provided to prevent an untimely opening of the flap when the refill is located in the pen body.

According to another special embodiment this object is achieved by the displacing apart of the two ramps by a distance substantially equal to the refill diameter in such a way that if the flap has a tendency to open, the second ramp is in direct contact with the end of the refill. Due to the fact that under the action of its return spring the refill applied against the stop members opposes a certain frictional resistance to any transverse displacement of the refill, the flap is thus prevented from pivoting unless an opening force is applied thereto which overcomes this resistance.

Other advantages and characteristics of the invention can be gathered from reading the following description relative to a non-limitative embodiment with reference to the attached drawings where show:

FIG. 1 an axial section of the pen according to the invention.

Figure 2:
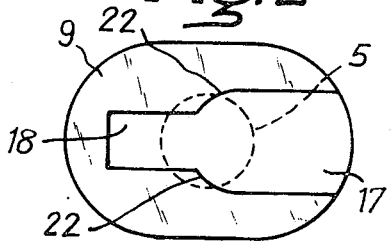

FIG. 2 a plan view of the pen, with the flap closed.

Figure 3:
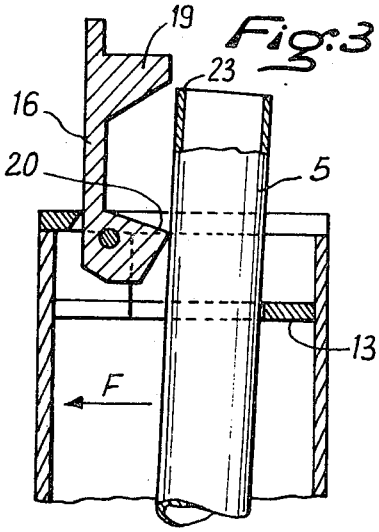

FIG. 3 an axial section of the upper portion of the pen with the flap open.

Figure 4:
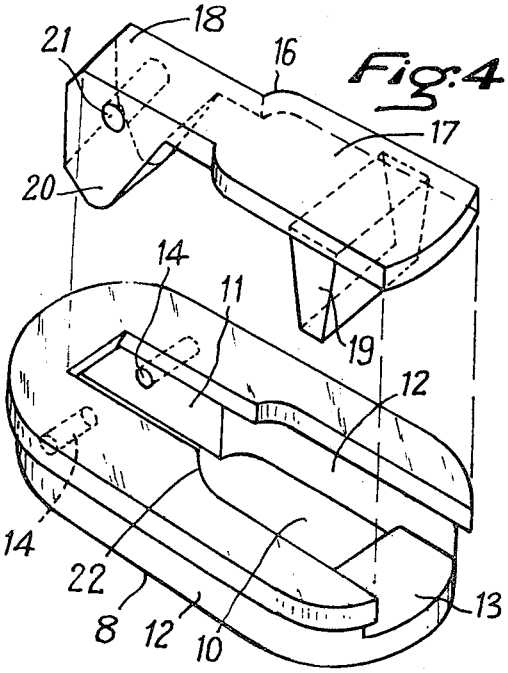

FIG. 4 an exploded perspective view of the pen body base portion and of the flap.

The pen according to the invention has an oval, cylindrical or non-cylindrical body 1, which is, for example, made from metal. In the lower portion of body 1 is rigidly fixed a head 2 carrying a screwed axial sleeve 3 through which emerges the writing head 4 of refill 5 axially centred in body 1. A return spring 6 applied between sleeve 3 and a shoulder 7 of refill 5 constantly tends to move refill 5 in a upwards direction.

The base of body 1 is constitued by a member 8 having a planar upper portion 9 in which is provided a passage orifice 10, whose shape is shown in FIG. 4. This orifice 10 is extended by an elongated opening 11 whose width, unlike orifice 10, is less than the refill diameter.

Member 8 also has two lateral flanges 12, separated by an inner slot whose width, beneath orifice 10 and beneath at least part of opening 11, is at least equal to the width of orifice 10.

The two flanges 12 are, however, joined on the open side of the slot constituting opening 10 by a flat cross-piece 13.

On the side of the narrowest opening 11 of portion 9 the two flanges 12 each has an orifice 14, whereby the two orifices 14 are aligned with one another. Member 8 is fixed in place by introducing the flanges 12 into body 1 until the upper portion 9, which extends beyond flanges 12, is applied against the upper edge of body 1. Member 8 is maintained in place either by forcing during its introduction or by any other means.

A flap 16 having a first wider portion 17 which is applied exactly into orifice 10 and a narrower portion 18 extending portion 17 and applied to orifice portion 11, is pivoted by means of a spindle 15 whose ends penetrate orifices 14. Flap 16 has two ramps which diverge from the lower surface of the flap, specifically a first ramp 19 extending beneath portion 17 and a second ramp 20 extending beneath portion 18 and receiving an orifice 21 permitting the passage of spindle 15.

The pen body thus contains no refill and with the flap raised in the position shown in FIG. 3 orifice 10 is accessible and it is possible to introduce into the same a refill 15, as can be seen in FIG. 3. When this refill is pushed downwards head 4 transverses spring 6 until shoulder 7 is applied against the said spring. In this position, shown in FIG. 3, the refill is slightly inclined due to the fact that orifice 10 is limited on the left hand side by convergent edges 22 which are laterally staggered to the right relative to the axial position of the refill, as shown by dotted lines 5 in FIG. 2. The refill is also guided by crosspiece 13.

With the refill in the position of FIG. 3 it is obvious that on pushing flap 16 to reclose it, ramp 19 comes into contact with the upper end 23 of refill 5 and moves the said refill in opposition to the thrust of spring 6. Thus, the refill slides along its own axis, as shown in FIG. 3 until its upper end 23 has been pushed by ramp 19 beneath the lower surface of portion 9. On further closing flap 16 ramp 19 then laterally pushes the refill 5 in the direction of arrow F until the refill assumes the position shown in FIG. 1, wherein it is perfectly centered along the pen axis. In this position the upper edge 23 of the refill is positioned beneath the lower surface of portion 9, level with zones 22. Thus the thrust of spring 6 applies end 23 of the refill against the said lower surface in such a way that the thrust of spring 6 is no longer transmitted to flap 16 which thus remains closed.

To change the refill it is merely necessary, from the position shown in FIG. 1, to open the flap, for example, with a finger nail. In this opening movement ramp 20 comes into contact with the left hand portion of refill 5 and as the flap turns ramp 20 laterally moves refill 5 in the direction opposite to arrow F and at a particular moment the upper edge 23 of refill 5 leaves zones 22 and the refill 5 is then moved upwards by spring 6 through orifice 10 to assume the position shown in FIG. 3 where it can be extracted manually.

It should also be noted that in the position shown in FIG. 1 not only can refill 5 not open the flap because it strikes against portion 9, but also it opposes an untimely opening of the flap. Thus, as shown in FIG. 1, when from the position where the flap is closed the latter starts to open, ramp 20, which is already substantially in contact with refill 5 prevents the flap from pivoting unless the user applies to the lever a force which is sufficient for ramp 20 to overcome the frictional force resulting from the contact of end 23 of the refill, under the thrust of spring 6, with the lower surface of portion 9 level with zones 22. If this locking is to be effective in the embodiment shown in FIG. 1 the base of ramp 20 must be in close contact with the side wall of the refill in the immediate vicinity of its upper edge 23. However, ramp 20 is not necessarily inclined as in FIG. 1, because it is the terminal zone 24 of ramp 20 which ensures the thrust in the direction opposite to arrow F.

Although the invention has been described relative to a specific embodiment it must be understood that the invention is not limited thereto and various modifications of form or material can be made without passing beyond the scope of the invention.

I claim:

1. A writing implement having a replaceable refill, said instrument comprising:

a hollow body having a base defining an orifice therein for the passage of said refill, resilient means in said body baissing said refill toward said base, a flap mounted on said body to swing about an axis substantially perpendicular to said refill to open and close said orifice, stop means defined by said base to one side of said orifice and so positioned that said refill can be gripped between said stop and said resilient means a ramp carried by said flap at the side thereof remote from said axis and positioned to force said refill beneath said stop as said flap is closed, and a projection carried by said flap at a point closer to said axis than said ramp and positioned to force said refill away from said stop into alignment with said orifice as said flap is opened.

2. A writing implement according to claim 1, in which the said stop means are formed by at least one surface extending from the edge of the passage orifice.

3. A writing implement according to claim 2, in which the passage orifice is extended by an opening whose width is less than the refill diameter, and in which the flap seals both orifice and opening.

4. A writing implement according to claim 1, having flap locking means for maintaining the flap in the closed position.

5. A writing implement according to claim 4, in which the projection is a second ramp spaced from the base of the first ramp by a distance which is substantially equal to the refill width.

6. A writing implement according to claim 5, in which the two ramps diverge as they extend away from the flap.

7. A writing implement according to claim 3, in which the base comprises a base portion mounted in the pen body and having a base part and two lateral spaced flanges, whereby the base part has an orifice whose width is greater than the refill diameter, communicating with an opening having a smaller diameter for forming stop surfaces level width with the thus defined narrow portion

8. A writing implement according to claim 3, in which the flap has a shape complementing the said orifices with a first wider portion remote from the axis carrying said ramp and a second narrower portion nearer said axis and carrying said projection.

9. A writing implement according to claim 7, in which the two flanges are joined by a cross-piece which guides the refill.

* * * * *